United States Patent [19]

Sueishi et al.

[11] Patent Number: 4,503,827

[45] Date of Patent: Mar. 12, 1985

[54] FUEL INJECTION SYSTEM FOR INTERNAL COMBUSTION ENGINE

[75] Inventors: Motoharu Sueishi, Toyota; Mitsuo Nakamura, Kariya, both of Japan

[73] Assignee: Nippondenso Co., Ltd., Kariya, Japan

[21] Appl. No.: 312,982

[22] Filed: Oct. 20, 1981

[30] Foreign Application Priority Data

Oct. 22, 1980 [JP] Japan ..... 55-148525

[51] Int. Cl.[3] ..... F02D 5/02

[52] U.S. Cl. ..... 123/478; 123/492

[58] Field of Search ..... 123/478, 488, 492, 493

[56] References Cited

U.S. PATENT DOCUMENTS

| | | | |
|---|---|---|---|
| 3,587,536 | 6/1971 | Inoue et al. | 123/478 |
| 3,699,932 | 10/1972 | Aono et al. | 123/478 |
| 4,109,616 | 8/1978 | Zechnall et al. | 123/478 |
| 4,121,545 | 10/1978 | Mizote | 123/488 |
| 4,196,702 | 4/1980 | Bowler | 123/478 |
| 4,200,063 | 4/1980 | Bowler | 123/478 |
| 4,204,483 | 5/1980 | Harada et al. | 123/493 |
| 4,388,907 | 6/1983 | Sugo et al. | 123/478 |

*Primary Examiner*—Andrew M. Dolinar

*Attorney, Agent, or Firm*—Cushman, Darby & Cushman

[57] ABSTRACT

A fuel injection system for internal combustion engines injects fuel simultaneously into cylinders at a controllable number of occurences of fuel injection. The fuel injection system includes a frequency divider for frequency-dividing a signal indicative of rpm of the engine, a gate means for selectively supplying an output from the frequency-divided signal to solenoid-operated fuel injection valves, and a comparator for controlling the gate means to feed the output from the frequency-divider to the fuel injection valves when a signal indicative of an engine load exceeds a reference value upon comparison, that is, when the engine operates under heavier loads.

2 Claims, 2 Drawing Figures

FUEL INJECTION SYSTEM FOR INTERNAL COMBUSTION ENGINE

BACKGROUND OF THE INVENTION

The present invention relates to a fuel injection system for internal combustion engines, in which the number or occurences of fuel injection is variable dependent on the engine load.

Conventional fuel injection systems for multi-cylinder internal combustion engines are provided with solenoid-operated fuel injection valves respectively for the engine cylinders, the valves being simultaneously actuatable by a control circuit to inject fuel twice or more time per engine stroke for an improved engine response.

In a conventional four-cycle multi-cylinder engine, fuel has normally been injected twice an engine stroke. When the engine rotates at a speed of 6,000 rpm, one engine stroke takes 20 msec., and the maximum possible injection time required by each solenoid-operated valve is 10 msec. as the fuel is injected twice in 20 msec.

The solenoid-operated valve presently available operates such that its needle will not be lifted immediately upon application of a voltage, and will remain lifted for a certain period of time when the voltage is cut off before the valve is closed. When the voltage is applied again right after the solenoid-operated valve is de-energized, the valve will not be closed and be left substantially open. With the interval of time in which the valve is de-energized or at rest being too short, no linearity is maintained between the width of a voltage pulse applied to the valve and the amount of fuel injected under the influence of a previously applied voltage pulse. It is therefore required to give the valve an increased period of time in which the valve is to be de-energized. Such a period of time is normally required to be 1.5 msec., and hence the maximum controllable width of a pulse applied at the engine speed of 6,000 rpm is 8.5 msec.

Since the solenoid-operated valve will not be open immediately in response to application of a voltage, the minimum controllable width of a pulse to be applied to the valve has a limitation, and no proper adjustment of the rate of fuel flow is normally possible with a pulse width of 2 msec. or shorter.

For fuel economy, some internal combustion engines introduce a reduced amount of intake air while the engine is idling, and also deliver an increased amount of intake air while the engine is rotating at higher speeds through the use of a turbo charger. Such a system is required to have a greater ratio of the maximum to the minimum widths of pulses applied for fuel injection or a greater range in which the pulse width is variable in order to supply an amount of fuel in proportion to the amount of intake air introduced. However, the minimum pulse width is governed by the construction of solenoid-operated valves used and voltages applied thereto, and the maximum pulse width is limited for the reason described above.

SUMMARY OF THE INVENTION

According to the present invention, there is provided a means for modifying a signal indicative of rpm of an internal combustion engine to change a number of occurences of fuel injection per engine stroke in response to a signal indicative of the load to which the engine is subjected. The means comprises a logic circuit including a pair of AND gates, an OR gate, inverter, and a comparator, and a frequency divider. When the load signal is greater than a reference value, the comparator allows the frequency divider to frequence-devide the rpm signal, thereby causing solenoid-operated valves to inject fuel at a reduced number of occurences per engine stroke.

It is an object of the present invention to provide a fuel injection system for internal combustion engines, in which the number of occurences of fuel injection per engine stroke is variable dependent on the engine load condition for supplying an amount of fuel to meet a wide range of engine loads and hence for improving the performance of the internal combustion engine.

The above and other objects and advantages of the present invention will become more apparent from the following description when taken in conjunction with the accompanying drawings in which a preferred embodiment of the invention is shown by way of illustrative example.

DETAILED DESCRIPTION OF THE PREFERRED EMBODIMENT

Figure 1:
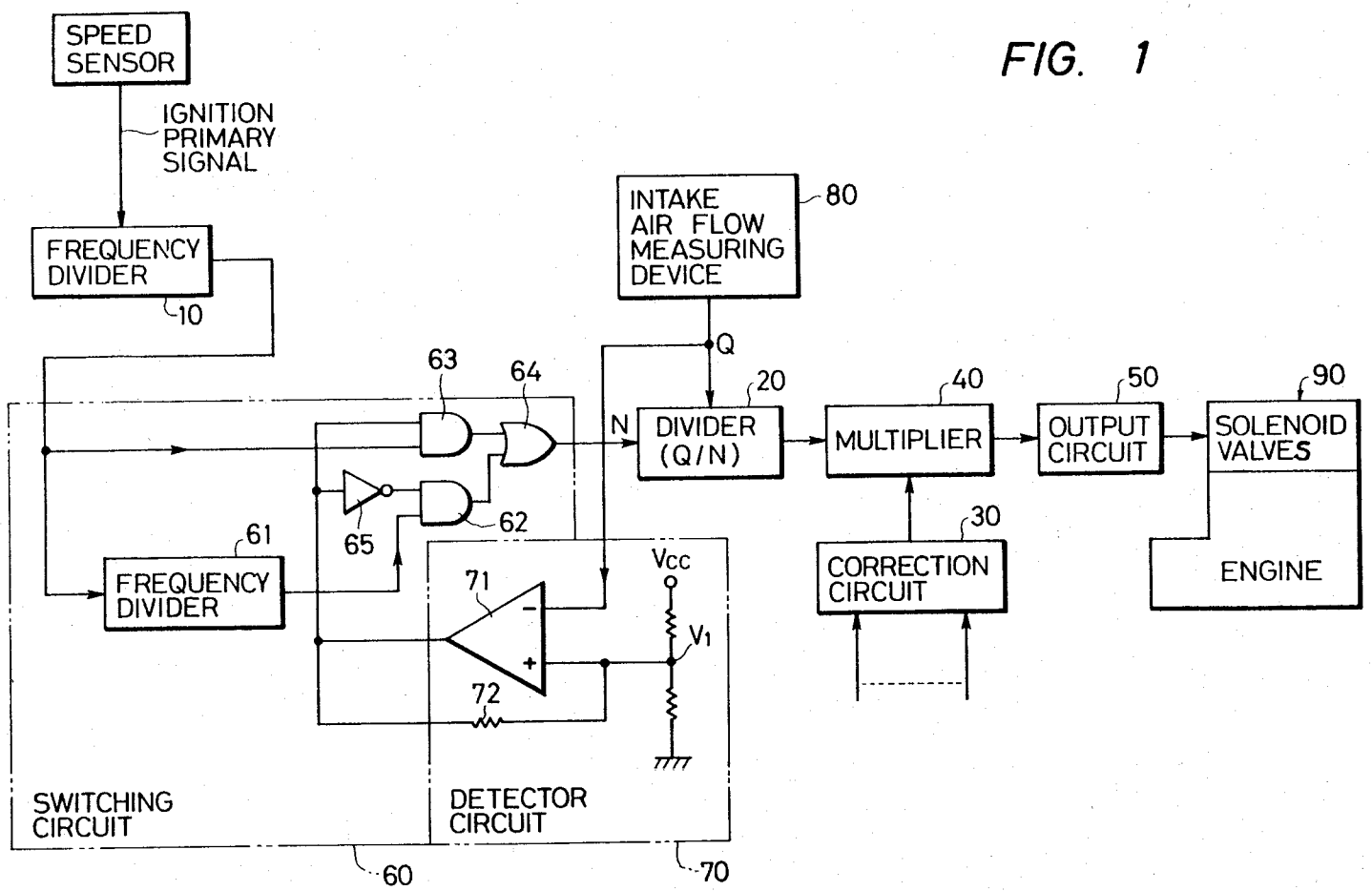
FIG. 1 is an electrical circuit diagram, partly in block form, of a fuel injection system according to the present invention.

The present invention will be described which is incorporated in a fuel injection system for a four-cycle four-cylinder internal combustion engine, the system being controllable by an ignition primary signal Ig detected as an engine rotational speed signal and a signal from an intake air flow measuring device, indicative of an amount Q of intake air. In FIG. 1, the frequency of the rotational speed signal is reduced to half by a frequency divider 10. A divider 20 divides the amount Q of intake air by an engine speed (N) to compute a base amount of fuel necessary for one stroke of the engine. A fuel correction circuit 30 generates a fuel correction signal on the basis of signals indicating conditions of the engine, such as the temperature of the coolant water, the temperature of intake air, or the like. A multiplier 40 multiplies an output signal from the divider 20 by the fuel correction signal from the fuel correction circuit 30. An output circuit 50 produces an output for energizing solenoid-operated fuel injection valves 90 for injecting fuel into the intake ports of the engine.

The fuel injection system according to the present invention includes a switching circuit 60 comprising a frequency divider 61 having an input connected to the output of the frequency divider 10, a pair of AND gates 62, 63 having one inputs connected respectively to the frequency dividers 61, 10, and an OR gate 64 having two inputs connected to the outputs of the AND gates 62, 63 and an output connected to the divider 20. The switching circuit 60 includes an engine load detecting circuit 70 responsive to detected load conditions of the engine for supplying a switching signal to the switching circuit 60. The detecting circuit 70 comprising a comparator 71 for comparing a signal Q indicative of the amount of intake air introduced from an intake air flow measuring device 80 with a reference voltage $V_1$, which is produced as a junction between two resistors to which a constant voltage Vcc is applied. The output of the comparator 71 is connected directly to the other input of the AND gate 63 and to an input of an inverter 65, the output of which is connected to the other input of the AND gate 62. Thus, the detector circuit 70 controls the AND gates 62, 63. The detector circuit 70 may be supplied with, instead of the signal Q from the intake air flow measuring device 80, an output pulsed signal delivered from the divider circuit 20 as an engine load parameter to detect an engine load condition by determining the width of such a pulsed signal. As an alternative, a means may be provided for detecting the pressure in an intake pipe as an engine load parameter so as to produce a signal indicating an engine load condition by determining the magnitude of the intake air pressure. The intake air measuring device 80 may comprise a baffle plate, hot wire, or Karman vortex to measure the amount of intake air flowing into the engine and to generate the signal Q indicative of the amount of intake air.

The fuel injection system thus constructed will operate as follows: The ignition primary signal Ig has a waveform as shown at (A) in FIG. 2, and is shaped and frequency-divided by the frequency divider 10 into a signal (B) having a frequency that is half the frequency of the ignition primary signal Ig. With a conventional arrangement, the output of the frequency divider 10 has directly been delivered to the divider circuit 20 and corrected to produce a pulsed signal (D) for energizing the solenoid-operated valve 90. Thus, each pulse (D) has conventionally been applied to the solenoid-operated valve 90 for every other ignitions or for one revolution of the engine.

According to the illustrated embodiment of the present invention, when the intake-air signal Q is smaller than the reference value, the comparator 71 produces an output having a logic level "1", whereupon the output from the frequency divider 10 is fed via the AND gate 63 and the OR gate 64 to the divider 20. The fuel injection system thus operates in the same manner as the prior fuel injection system. When the intake air flow signal Q is greater than the reference value, that is, when the volume of intake air exceeds a predetermined volume, the comparator 71 produces an output having a logic level "0", allowing the output from the frequency divider 10 to be delivered to the frequency divider 61 wherein the frequency of the signal from the frequency divider 10 is reduced to half as shown at (C) in FIG. 2. The output signal from the frequency divider 61 is supplied via the AND gate 62 and the OR gate 64 to the divider 20.

Figure 2:
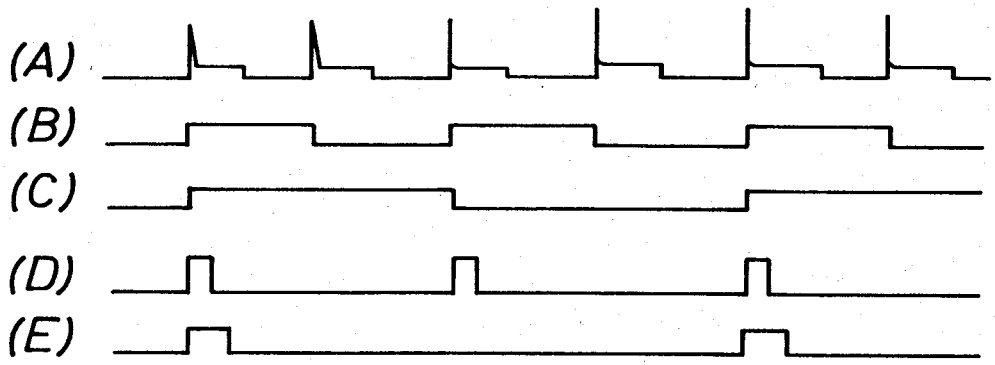
FIG. 2 is a diagram showing waveforms of signals explanatory of the fuel injection system.

With the signal thus frequency-divided further by the frequency divider 61, the engine rpm is regarded as being reduced to half, and each output pulse from the divider 20 has a width that is twice larger than would otherwise be and hence has a waveform as shown at (E) in FIG. 2 for enabling the solenoid-operated valve 90 to inject an amount of fuel at one time which would otherwise be separated and injected twice.

To prevent hunting as experienced when the fuel injection system operates in the vicinity of reference voltage $V_1$, the engine load detecting circuit 70 should preferably include a feedback resistor 72 to give the reference value hysterisis.

While the fuel injection system illustrated computes an amount of fuel to be injected on the basis of an amount of intake air, the present invention is also applicable to a fuel injection system for computing an amount of fuel to be injected in response to the detection of the pressure in an intake pipe, in which case a signal indicative of such intake air pressure or computed data indicative of a basic amount of fuel to be injected serves an engine load parameter and is compared with a reference value.

Although in the illustrated embodiment the fuel injection system analogically computes an amount of fuel to be injected, the present invention is applicable to a fuel injection system incorporating a microcomputer for digital computation of an amount of fuel to be injected. With such an alternative arrangement, the program for the microcomputer should include a routine for computing an amount of fuel to be injected, the routine having a step for comparing the amount of intake air or pressure in an intake pipe, which is indicative of an engine load parameter, with a predetermined value. The microcomputer is also programmed such that when the engine load is determined as being larger than the reference value, fuel is injected at one time, instead of two times, per engine stroke in an amount which is about twice as large as that of fuel injected in normal engine load conditions.

With the present invention, the range in which the width of a pulse for energizing fuel injection valves is variable can be substantially widened, an arrangement which improves the precision with which the amount of fuel to be injected is adjustable while the engine operates under heavier loads.

Although a certain preferred embodiment has been shown and described in detail, it should be understood that various changes and modifications may be made therein without departing from the scope of the appended claims.

What is claimed is:

1. A fuel injection system for an internal combustion engine, comprising:
   - first means for detecting the rotational speed of the engine;
   - second means for detecting an intake air flow for the engine;
   - solenoid-operated fuel injection valves for supplying fuel to the engine; and
   - electronic control means responsive to signals delivered from said first and second means for causing all of said solenoid-operated fuel injection valves to be opened simultaneously for the same interval of time both above and below a predetermined value of the intake air flow, said electronic control means including means for computing the duration of pulses to be applied to said fuel injection valves in response to the signal from said second means and means responsive to the signals from said first and second means for changing a number of occurrences per engine stroke of fuel injection so as to be smaller when said intake air flow is greater than said predetermined value than when said intake air flow is smaller than said predetermined value.

2. A fuel injection system for an internal combustion engine having a plurality of cylinders, comprising:
   - first means for producing a signal indicative of the speed of rotation of the engine;
   - second means for injecting fuel simultaneously into the engine cylinders at a controllable number of occurrences per engine stroke;
   - third means for detecting an engine load to produce a signal indicative of the detected engine load;
   - fourth means responsive to said signal from said detecting means for changing said controllable number of occurrences per engine stroke of fuel injection, such that said controllable number is controlled so as to be smaller when said engine load is larger than a predetermined value than when said engine load is smaller than said predetermined value, wherein said fourth means comprises first and second frequency dividers for frequency-dividing said signal from said first means respectively into first and second pulse signals having different pulse durations, a comparator for comparing said signal from said third means with a reference value, and switching means responsive to an output signal from said comparator for selecting one of said first and second pulse signals, and fifth means responsive to said selected pulse signal for computing the duration of pulses to be applied to said second means for actuating the latter.

* * * * *